US005360531A

United States Patent [19]

Tong et al.

[11] Patent Number: 5,360,531

[45] Date of Patent: Nov. 1, 1994

[54] PHOSPHORIC TRIAMIDE COKING INHIBITORS

[75] Inventors: Youdong Tong, Houston; Michael K. Poindexter, Sugar Land, both of Tex.

[73] Assignee: Nalco Chemical Company, Naperville, Ill.

[21] Appl. No.: 71,458

[22] Filed: Jun. 2, 1993

Related U.S. Application Data

[63] Continuation-in-part of Ser. No. 990,782, Dec. 10, 1992, abandoned.

[51] Int. Cl.[5] ..... C10G 9/16

[52] U.S. Cl. ..... 208/48 AA; 208/48 R; 585/648; 585/650; 585/950

[58] Field of Search ..... 208/48 R, 48 AA, 70; 585/648, 650, 950

[56] References Cited

U.S. PATENT DOCUMENTS

| | | | |
|---|---|---|---|
| 2,998,379 | 8/1961 | McKinley et al. | 208/70 |
| 3,364,130 | 1/1968 | Barnum et al. | 208/48 AA |
| 3,531,394 | 9/1970 | Koszman | 208/48 AA |
| 3,558,470 | 1/1971 | Gillespie et al. | 208/48 AA |
| 4,105,540 | 8/1978 | Weinland | 208/48 AA |
| 4,542,253 | 9/1985 | Kaplan et al. | 585/650 |
| 4,835,332 | 5/1989 | Kisalus | 585/650 |
| 4,842,716 | 6/1989 | Kaplan et al. | 208/48 AA |
| 4,900,426 | 2/1990 | Kisalus | 208/48 AA |
| 4,941,994 | 6/1990 | Zetlmeisel et al. | 252/389 |

OTHER PUBLICATIONS

Zhurba et al., "Triamides of Phosphoric and Thiophosphoric Acids As Antioxidants of Hydrocarbons", NEFTEKHIMIYA, 15(5), 783–8, 1975.

*Primary Examiner*—Helane Myers
*Assistant Examiner*—Walter D. Griffin
*Attorney, Agent, or Firm*—Robert A. Miller; James J. Drake; Daniel N. Lundeen

[57] ABSTRACT

Inhibiting coke formation on heat transfer surfaces used to heat or cool a petroleum feedstock at coke-forming conditions. The heat transfer surfaces are treated with an effective amount of tripiperidinophosphine oxide to inhibit coke formation on the heat transfer surfaces. The tripiperidinophosphine oxide is essentially free from contributing to corrosion and from producing catalyst-impairing by-products.

20 Claims, 1 Drawing Sheet

PHOSPHORIC TRIAMIDE COKING INHIBITORS

CROSS-REFERENCE TO RELATED APPLICATION

This application is a continuation-in-part of our copending U.S. Ser. No. 07/990 782 filed Dec. 10 1992, now abandoned.

FIELD OF THE INVENTION

The invention relates to an antifouling process for treating heat transfer surfaces which heat or cool various hydrocarbon feedstocks, often in the presence of steam, at conditions tending to promote the formation of coke on the surfaces, and more particularly, to phosphoric triamides for use as an antifoulant.

BACKGROUND OF THE INVENTION

Ethylene manufacture entails the use of pyrolysis or cracking furnaces to manufacture ethylene from various gaseous and liquid petroleum feedstocks. Typical gaseous feedstocks include ethane, propane, butane and mixtures thereof. Typical liquid feedstocks include naphthas, kerosene, and atmospheric/vacuum gas oil. When gaseous or liquid hydrocarbon feedstocks are pyrolyzed in the presence of steam, significant quantities of ethylene and other useful unsaturated compounds are obtained. Steam is used to regulate the cracking reaction of saturated feedstocks to unsaturated products. The effluent products are quenched and fractionated in downstream columns, and then further reacted or processed depending on need.

Fouling of cracking furnace coils, transfer line exchangers (TLEs) and other heat transfer surfaces occurs because of coking and polymer deposition. The fouling problem is one of the major operational limitations experienced in running an ethylene plant. Depending on deposition rate, ethylene furnaces must be periodically shut down for cleaning. In addition to periodic cleaning, crash shutdowns are sometimes required because of dangerous increases in pressure or temperatures resulting from deposit buildup in the furnace coils and TLEs. Cleaning operations are carried out either mechanically or by passing steam and/or air through the coils to oxidize and burn off the coke buildup.

A major limitation of ethylene furnace run length is coke formation in the radiant section and transfer line exchangers (TLEs). The coke is normally removed by introducing steam and/or air to the unit which in effect burns off carbonaceous deposits. Since coke is a good thermal insulator, the furnace firing must be gradually increased to provide enough heat transfer to maintain the desired conversion level. Higher temperatures shorten the tube life, and tubes are quite expensive to replace. Additionally, coke formation decreases the effective cross-sectional area of the process gas, which increases the pressure drop across the furnace and TLEs. Not only is valuable production time lost during the decoking operation, but also the pressure buildup resulting from coke formation adversely affects ethylene yield. Run lengths for ethylene furnaces average from one week to four months depending in part upon the rate of fouling of the furnace coils and TLEs. This fouling rate is in turn dependent upon the nature of the feedstock as well as upon furnace design and operational parameters. In general, however, heavier feedstocks and higher cracking severity results in an increased rate of furnace and TLE fouling. A process or additive that could increase run length would lead to fewer days lost to decoking and lower maintenance costs.

Significant effort has been exerted over the past twenty years in developing phosphorus, in numerous forms, as a coke inhibitor. See U.S. Pat. No. 3,531,394 to Koszman (phosphoric acid); U.S. Pat. No. 4,105,540 to Weinland (phosphate and phosphite mono and diesters); U.S. Pat. Nos. 4,542,253 and 4,842,716 to Kaplan et al. (amine complexes of phosphate, phosphite, thiophosphate and thiophosphite mono and diesters); U.S. Pat. No. 4,835,332 to Kisalus (triphenyl phosphine); and U.S. Pat. No. 4,900,426 to Kisalus (triphenyl phosphine oxide). Compared with other element-based additives, many of these phosphorus-based antifoulants have performed extremely well with respect to coke suppression in both lab simulations and industrial applications; however, some have yielded detrimental side effects preventing prolonged usage in many situations, e.g., contributing to corrosion, impairing catalyst performance, or the like.

Convection section corrosion has been a problem with many phosphorus-based anticoking additives of the prior art. Along the path of the convection section tubing, conditions are constantly changing. Heated steam and hydrocarbon are typically introduced to the section separately and then mixed well before entering the radiant section. During the numerous passes that the streams experience, separated or mixed, there can be temperatures, pressures, and compositions which enhance the conversion of antifoulants to detrimental corrosive by-products. A product which is an excellent coke suppressant may also be an extremely corrosive species if it accumulates in the convection section.

Once additives pass through the convection, radiant, and TLE sections, they are subject to effluent quench conditions. In a very simplified view, heavy products concentrate in the primary fractionator, water quench tower, caustic tower and/or compressor knock-out drums, while the lighter components are fractionated in columns downstream of the compressors. Accumulation of coke inhibitors and their cracked by-products is dictated mainly by their physical properties. Briefly, inhibitor by-products with high boiling points are condensed early in the fractionation process while lighter ones progress to the later stages.

Accumulation of antifoulants and/or their by-products in the radiant and TLE coke, primary fractionator, or water quench tower, is for the most part acceptable. These sections process and collect many other heavy products which are quite impure and thus, trace amounts of an additive generally do not have a significant impact.

In contrast, additives and/or by-products that go past the caustic tower and compressor sections can be a significant problem. Past these sections, purity becomes an important issue since the downstream fractionation generally separates the unsaturated products into high purity chemicals. The presence of phosphorus-containing products which might adversely affect the performance of catalysts used to process these lighter components is unacceptable.

Many phosphorus-containing products are good ligands and can adversely affect the catalyst performance. The phosphorus by-product which is of greatest concern is phosphine ($PH_3$). This by-product is extremely low-boiling (−88° C.). In fact, it has basically the same boiling point as acetylene (−84° C.), a hydrocarbon by-product which is often catalytically hydrogenated to the more desired ethylene.

Accordingly, there remains a need for a phosphorus-based anticoking additive for cracking furnaces which is essentially free from contributing to corrosion and from forming catalyst impairing by-products.

SUMMARY OF THE INVENTION

The present invention is a method for the use of a new antifoulant and coke suppressant, a phosphoric triamide, to reduce fouling in various high temperature applications, including steam cracking furnaces. The phosphoric triamide is used to treat heat transfer surfaces used to heat or cool a petroleum feedstock at coke-forming conditions. The heat transfer surfaces are contacted with an effective amount of a phosphoric triamide of the formula $R_3P{=}X$, wherein each R is an amino moiety of the formula $-NR^1R^2$ wherein $R^1$ is hydrocarbyl and $R^2$ is hydrogen or hydrocarbyl, and $R^1$ and $R^2$ taken together can, and preferably do, form a heterocyclic moiety; and wherein X is chalcogen, preferably sulfur, and especially oxygen. The heat transfer surfaces can be contacted with the inhibitor in several different ways, including, for example, pretreating the heat transfer surfaces prior to heating or cooling the petroleum feedstock, continuously or intermittently adding a trace amount of the additive to the petroleum feedstock as it is being heated or cooled, adding the phosphoric triamide to steam feed which is then mixed with the petroleum feedstock, to the petroleum feedstock itself, or to a feed mixture of the petroleum feedstock and steam, and the like.

Where the petroleum feedstock being heated or cooled is treated with the phosphoric triamide, the additive is preferably added at a rate from about 0.1 to about 1000 ppm, on a basis of elemental phosphorus in the additive, more preferably from about 1 to about 100 ppm, by weight of the petroleum feedstock.

Each $R^1$ and $R^2$ in the foregoing phosphoric triamide formula is preferably alkyl, aryl, alkylaryl, or arylalkyl, wherein the phosphoric triamide preferably has from 3 to about 48 carbon atoms, and more preferably, each of $R^1$ and $R^2$ have from 1 to 8 carbon atoms. More preferably, each heterocyclic moiety has from 4 to 12 carbon atoms and is selected from pyrrolyl, pyrrolinyl, pyrrolidinyl, piperidino, dihydropyridinyl, tetrahydropyridinyl, azepinyl, indolyl, indolinyl, isoindolinyl, carbazolyl and the like.

For the purposes of this invention, coke formation is defined as any buildup of coke or coke precursors on the heat transfer surfaces, including convection coils, radiant furnace coils, transfer line exchangers, quench towers, or the like. Other phosphorus-containing compounds have been disclosed in various patents and other references as effective coke formation inhibitors. However, none of the phosphorus compounds provide the same performance as the presently preferred phosphoric triamides. Performance is based not only on the anticoking agent's ability to suppress and inhibit coke formation, but just as importantly, on being essentially free from causing any harmful side effects associated with many of the prior art additives, such as contributing to corrosion or impairing catalyst performance.

As used herein, petroleum feedstock is used to refer to any hydrocarbon generally heated or cooled at the heat transfer surfaces, regardless of the degree of previous processing, and specifically when used in reference to an ethylene or other cracking furnace, refers to the hydrocarbon before processing, as well as the hydrocarbon during and after processing in the furnace itself, in the TLE, in the quench section, etc. The feedstock can include ethane, propane, butane, kerosene, naphtha, gas oil, combinations thereof, and the like.

DESCRIPTION OF THE INVENTION

Figure 1:
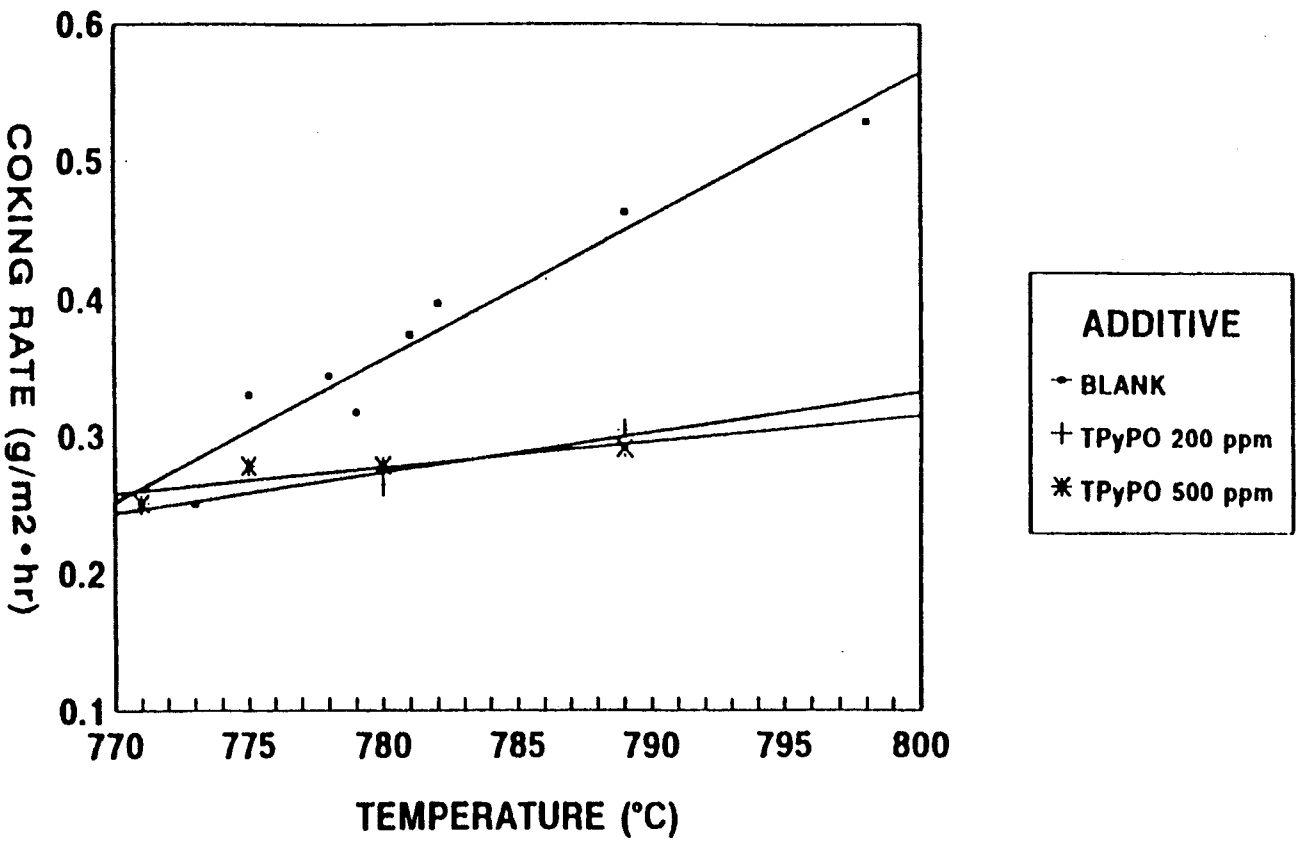
FIG. 1 is a graph of coking rates obtained by inhibition with tripiperidinophosphine oxide over a typical cracking furnace operating temperature range according to the present invention.

The coking inhibitor of the present invention is a phosphorus-based compound which is preferably essentially non-corrosive and is preferably essentially free from phosphine formation under general conditions for hydrocarbon cracking. The present anti-coking agent has the following general formula:

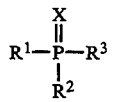

wherein X is chalcogen, preferably sulfur, and especially oxygen; and wherein each $R^1$ through $R^3$ is independently an amino moiety of the formula:

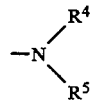

wherein each $R^4$ is independently hydrocarbyl, such as, for example, alkyl, aryl, alkylaryl, arylalkyl, or the like, and each $R^5$ is independently hydrogen or hydrocarbyl, and $R^4$ and $R^5$ taken together can, and preferably do form a heterocyclic moiety, such as, for example, pyrrolyl, pyrrolinyl, pyrrolidinyl, piperidino, dihydropyridinyl, tetrahydropyridinyl, azepinyl, indolyl, indolinyl, isoindolinyl, carbazolyl and the like. This class of nitrogen-containing phosphorus compounds is referred to generally herein as phosphoric triamides, but are sometimes also known as phosphoramides or triaminophosphine oxides or sulfides.

The phosphoric triamide preferably has from 3 to about 48 carbon atoms, and more preferably from 12 to 24 carbon atoms. Each hydrocarbyl group $R^4$ and $R^5$ (where they do not form a heterocyclic amino moiety) preferably comprises from 1 to 15 carbon atoms. Each heterocyclic amino moiety (where $R^4$ and $R^5$ taken together form the heterocyclic moiety) preferably has from 4 to 12 carbon atoms. If the number of carbon atoms in the amino moieties is excessively large, the economics of the additive are less favorable, the additive can lose volatility and miscibility to mix properly in the petroleum feedstock being treated, or can lose the desired stability. The hydrocarbyl groups can be substituted with or contain a heteroatom such as a chalcogen, pnicogen, or the like, but this is generally less preferred because of the concomitant instability imparted by the heteroatom. However, in some situations, where the heteroatom will impart solubility in steam or water, for example, the presence of a heteroatom can be useful, especially where the heteroatom is in a terminal portion of the hydrocarbyl group spaced from the amino moiety, so that any cleavage or other reaction of the heteroatom will leave the triaminophosphine moiety substantially intact for anticoking effectiveness.

The hydrocarbyl groups can be the same or different in each amino moiety, for example, where the phosphoric triamide is formed from a mixture of different amines, and/or reacted with different amines in a stepwise fashion. In many instances, it is not necessary that the phosphoric triamide be completely pure, and the reaction product obtained by using isomers or mixtures of amines, which may be more economically available than the pure amines, are generally suitable.

Specific representative examples of the anticoking additives include tripiperidinophosphine oxide, hexamethyl phosphoramide, hexaoctyl phosphoramide, hexaphenyl phosphoramide and the like. Phosphoric triamides wherein the amino moieties are cyclic groups, particularly piperidino and pyrrolidinyl, are preferred for the characteristics of noncorrosivity and being essentially free of phosphine formation, as well as coke suppression. For the purposes of clarity and convenience, and not by way of limitation, the anti-coking agent is referred to herein generally as the preferred tripiperidinophosphine oxide (TPyPO) with the understanding that this is just one example of the phosphoric triamides of the present invention.

The phosphoric triamides are prepared according to methods known in the art, and in some cases are commercially available. Generally, the phosphoric triamides can be prepared by the reaction of phosphorus oxyhalide, e.g. phosphorus oxybromide or phosphorus oxychloride, with an excess of the desired amine, e.g. piperidine, in a suitable solvent such as heavy aromatic naphtha, toluene, benzene, etc., with evolution of the corresponding hydrohalide. Other bases which are less nucleophilic (e.g pyridine) may also be incorporated to help drive the desired transformation. Alternatively, the phosphoric triamide can be prepared from the corresponding phosphorus triamide which is oxidized or sulfurized. In some cases, it may be possible to effectively convert phosphorous triamide to the corresponding phosphoric triamide in situ in the cracking furnace, in accordance with the present invention.

The TPyPO is used to inhibit coke formation on heat transfer surfaces used most often to heat, but sometimes to cool, petroleum feedstocks at coke-forming conditions, by treating the surfaces with an effective amount of the TPyPO. The surface can be effectively treated, for example, by introducing the TPyPO into the petroleum feedstock before the feedstock comes into contact with the heat transfer surfaces.

In general, the TPyPO can be used in an amount effective to obtain the desired inhibition of coke formation, usually at least 0.1 ppm by weight in the hydrocarbon, preferably at least 1 ppm, on a basis of elemental phosphorus. There is usually no added benefit in using the TPyPO in a relatively high concentration, and the economics are less favorable. Preferably, the TPyPO is used in an amount from about 0.1 to about 1000 ppm, more preferably from about 1 to about 100 ppm, by weight in the hydrocarbon, on an elemental phosphorus basis.

The addition to the petroleum feedstock is preferably continuous, but it is also possible to use the petroleum feedstock treatment on an intermittent basis, depending on the coke inhibition which is desired in the particular application. For example, where there is a scheduled shutdown of the heat transfer equipment for maintenance, other than for the build up of coke deposits, the continuous addition of the TPyPO to the petroleum feedstock could be terminated in advance of the shutdown. Or, the anti-coking agent could be used in the petroleum feedstock after the development of a pressure drop through the heat transfer equipment indicative of coke formation therein.

It is also possible to treat the heat transfer surfaces before they come into contact with the petroleum feedstock, for example, by applying the TPyPO as a pretreatment or as a treatment between production runs. As a pretreatment, the TPyPO can be circulated through the heat transfer equipment, preferably in a suitable diluent. The heat transfer equipment can also be filled with the TPyPO solution and allowed to soak for a period of time to form a protective film on the heat transfer surfaces. Similarly, the petroleum feedstock can be dosed at a relatively high initial rate, for example, at the beginning of a run, e.g. 0.5 to 2.0 weight percent, and after a period of time, e.g. 1 to 24 hours, reduced to the continuous dosage rates described above.

Where the petroleum feedstock being heated or cooled is being treated on a generally continuous basis, the TPyPO is preferably added as a solution in a master batch. The mode of blending the TPyPO with the feedstock is not particularly critical, and a vessel with an agitator is all that is required. However, most conveniently, a master batch of the TPyPO in a suitable solvent, such as aliphatic or aromatic hydrocarbon, is metered into a stream of the feedstock and intimately mixed therein by turbulence in the processing equipment. Also, the TPyPO can be added to a steam or water stream which is injected or otherwise added to the petroleum feedstock stream, or the TPyPO can be added to a mixed stream of the petroleum feedstock and steam or water.

The TPyPO should be added to the feedstock upstream of the heat transfer surfaces being treated. The TPyPO addition should be sufficiently upstream to allow sufficient mixing and dispersion of the additive in the feedstock, but preferably not too far upstream in order to avoid or minimize any significant decomposition or degradation of the TPyPO before it reaches the surfaces being treated.

The invention is illustrated by way of the following examples.

EXAMPLES

In the following examples, various phosphorus compounds were evaluated and compared for coke inhibition, corrosivity and phosphine formation. The additives used are designated as indicated in Table 1.

TABLE 1

| ADDITIVE | ACTIVE COMPONENT |
|---|---|
| A | Tripiperidinophosphine oxide |
| B | Amine-neutralized thiophosphate mono/diester* |
| C | O,O,O-Triphenyl phosphate |
| D | Amine-neutralized phosphate mono/diester* |
| E | Diphenyl phosphinic acid** |
| F | Triphenylphosphine |
| G | Borane-tributylphosphine complex |
| H | Triphenyl phosphine oxide |

*Alkyl groups were $C_6$–$C_{10}$ paraffins; neutralized with morpholine.
**Neutralized with morpholine.

For coke suppression data, a laboratory reactor was used to simulate conditions used in a typical ethylene furnace. The reactor is described in U.S. Pat. No. 4,835,332, which is hereby incorporated herein by reference. All weights and percentages are on a weight basis unless otherwise indicated.

Example 1

Tripiperidinophosphine oxide (TPyPO) was evaluated for coke suppression at 200 ppm and 500 ppm in n-hexane. The hexane was fed into the test reactor at 38–40 g/hr with steam dilution at 0.5 kg/kg hexane, and a $V/F_0$ value of 41–43 liter.sec/mol, where V is the equivalent reactor volume (in liters) and $F_0$ is the initial molar flow rate of hexane (in moles/sec). The results illustrated in FIG. 1 show that Additive A reduces the asymptotic coking rate over a range of temperatures above about 770° C. This performance is comparable to the performance of other phosphorus-based additives reported in U.S. Pat. Nos. 4,842,716; 4,835,332; and 4,900,426.

Example 2

A high temperature wheel box was used to determine the degradative properties of various additives over long periods of time. To accelerate corrosion effects, Additive A was used at a concentration of 5 percent in heavy aromatic naphtha, and other additives were used at an equivalent phosphorus content. The additive was added to a high alloy vessel along with hydrocarbon, an equal amount of water and preweighed coupons constructed of carbon steel. The contents were rotated continuously at temperatures representative of a typical convection section of an ethylene furnace; the mixing ensured that the coupons would be exposed to both a liquid and a gas phase (composed of water and hydrocarbon). Exposing the additives to high temperature for extended periods of time permitted potential decomposition to harmful by-products. In essence, this method simulated a worse case scenario involving a fairly high concentration of an additive in the convection section with eventual accumulation/degradation (e.g. thermolysis, hydrolysis, disproportionation, etc. ) to by-products which may or may not be corrosive. Additionally, the appearance of corrosion may not be the direct result of degradation, but may be an inherent property of an additive. In Table 2, test data for Additive A is compared against three other compounds, two of which were amine-neutralized phosphate esters mono- and di-substituted with alkyl groups, known coke suppressants with aggressive corrosivity. As can be seen, the tripiperidinophosphine oxide (A) exhibited excellent performance. The same was not true for the other phosphorus-based compounds.

TABLE 2

| ADDITIVE | WEIGHT LOSS (mg) |
|---|---|
| A (TPyPO) | 9.2 |
| B | 90 |
| C | 115 |
| D | 120 |
| NONE | 1.6 |

Example 3

A lab unit was constructed which would simulate the dynamic (i.e erosive and corrosive) conditions of a typical convection section of an ethylene furnace. Corrosion is more likely to occur at or near the bends/elbows of the convection sections because of high erosion due to the velocity of the stream. Steam, generated from one vessel, was mixed with hydrocarbon (hexane and toluene at 50—50 weight percent) from a second vessel (steam:hydrocarbon weight ratio 0.5–0.6). Heating to the desired temperature was accomplished by passing the mixture through two independent furnaces held at specified temperatures (100°–600° C.). Both furnaces were monitored and controlled via two separate temperature controllers. Preweighed corrosion coupons, made of carbon steel, were situated at the bends within the furnace coil. Coupon A was situated in the process flow, subjected to the erosive and corrosive nature of the process stream, upstream and at a lower temperature (above 100° C.) relative to Coupon B which was situated downstream at a higher temperature (less than 600° C.). Thermocouples were used to record the temperature of both coupons as well as both furnace sections.

The additives were added to the hydrocarbon feed and tested under conditions identical to a blank (without additive). Coupon weight loss for several additives is given in Table 3. Tripiperidinophosphine oxide (A), at 2.4 weight percent in the hydrocarbon, gave excellent results compared to the others tested, at an equivalent phosphorus content.

TABLE 3

| | WEIGHT LOSS (mg) | |
|---|---|---|
| ADDITIVE | COUPON A | COUPON B |
| A (TPyPO) | 1.3 | 4.7 |
| B | 4.3 | 23.1 |
| D | 2.5 | 15.2 |
| E | 1.4 | 31.3 |
| NONE | 1.2 | 1.2 |

Example 4

To determine the propensity of various phosphorus-based products to yield $PH_3$, a known catalyst poison, additives were evaluated in the apparatus described in Example 3. Additive A was used at 5 weight percent in the hydrocarbon, and all other additives were used at an equivalent phosphorus content. To achieve the proper cracking temperature, a radiant section (750°–950° C.) was added just after the convection section. To more accurately simulate a typical ethylene furnace downstream quenching process, the effluent gases were passed through several vessels maintained at low temperatures (0° C. and −78° C.), a caustic scrubber, and a dryer containing 3 Å molecular sieves. Phosphine production levels given in Table 4 below are relative to each other (Additive F reading=100) and were determined by the colorimetric reading taken from a gas detector situated downstream of all the condensers. A low value indicates little $PH_3$ was produced while higher values indicate larger levels were produced. As a second confirmation that $PH_3$ was being produced by the phosphorus based chemicals, the cracked gas effluent was bubbled through deuterated chloroform at low temperatures (−78° C.) and analyzed by $^{31}$PNMR at −60° C. The spectrum obtained matched $PH_3$ from the literature (−234 ppm, quartet with $J_{pH}$192 Hz).

TABLE 4

| ADDITIVE | $PH_3$ RATE |
|---|---|
| A (TPyPO) | 4.7 |
| F | 100 |
| G | >250 |
| H | 20 |

TABLE 4-continued

| ADDITIVE | $PH_3$ RATE |
|---|---|
| NONE | NONE |

From the foregoing data, it is seen that the tripiperidinophosphine oxide was as effective in coke suppression as the prior art phosphorus-based additives, but was essentially free from contributing to corrosion and from forming phosphine. It is further seen that the other phosphorus-based additives evaluated either contributed to corrosion or formed phosphine under coking conditions.

The foregoing description of the invention is illustrative and explanatory thereof, and not intended in any limiting sense. Various changes in the materials, apparatus, steps, procedures and particular parts and ingredients will occur to those skilled in the art. It is intended that all such variations within the scope and spirit of the appended claims be embraced thereby.

We claim:

1. A method for inhibiting coke formation on heat transfer surfaces used to heat or cool a petroleum feedstock at coke-forming conditions, comprising:

contacting the heat transfer surfaces with an effective amount of a phosphoric triamide of the formula:

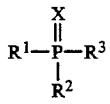

wherein X is chalcogen and each $R^1$ through $R^3$ is an amino moiety of the formula:

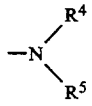

wherein $R^4$ is hydrocarbyl, and $R^5$ is hydrogen or hydrocarbyl, and $R^4$ and $R^5$ taken together can form a heterocyclic moiety.

2. The method of claim 1, wherein X is oxygen or sulfur.

3. The method of claim 2, wherein the phosphoric triamide comprises from 3 to 48 carbon atoms.

4. The method of claim 3, wherein the hydrocarbyls are free of heteroatoms.

5. The method of claim 4, wherein each of $R^4$ and $R^5$ is independently alkyl, aryl, alkylaryl or arylalkyl having from 1 to 15 carbon atoms.

6. The method of claim 3, wherein the amino moieties comprise heterocyclic moieties having from 4 to 12 carbon atoms.

7. The method of claim 6, wherein the amino moieties are selected from pyrrolyl, pyrrolinyl, pyrrolidinyl, dihydropyridinyl, tetrahydropyridinyl, piperidino, azepinyl, indolyl, isoindolinyl, indolinyl, and carbazolyl.

8. The method of claim 1, wherein the phosphoric triamide comprises tripiperidinophosphine oxide.

9. The method of claim 1, wherein the petroleum feedstock being heated or cooled is treated with from 0.1 to 1000 ppm on a basis of elemental phosphorus in the phosphoric triamide by weight of the feedstock.

10. The method of claim 1, wherein the petroleum feedstock being heated or cooled is treated with from 1 to 100 ppm on a basis of elemental phosphorus in the phosphoric triamide by weight of the feedstock.

11. The method of claim 1, wherein the petroleum feedstock includes ethane, propane, butane, naphtha, kerosene, gas oil, or a combination thereof.

12. The method of claim 1, wherein the heat transfer surfaces comprise cracking furnace coils.

13. The method of claim 1, wherein the heat transfer surfaces comprise transfer line exchangers.

14. The method of claim 1, wherein the heat transfer surfaces are pretreated with the phosphoric triamide before heating or cooling the petroleum feedstock.

15. The method of claim 6, comprising:

adding the phosphoric triamide to a petroleum feedstock; and passing the resulting admixture through convection and radiant sections of a cracking furnace.

16. The method of claim 15, further comprising fractionating the furnace effluent and catalytically treating a fraction thereof.

17. The method of claim 6, comprising:

adding the phosphoric triamide to a petroleum feedstock or ethylene furnace effluent upstream from a transfer line exchanger; and passing effluent from the cracking furnace containing the phosphoric triamide through the transfer line exchanger.

18. The method of claim 17, further comprising fractionating the furnace effluent and catalytically treating a fraction thereof.

19. The method of claim 6, comprising:

adding the phosphoric triamide to steam;

mixing the steam with a petroleum feedstock;

passing the admixture of feedstock and steam containing the phosphoric triamide through a cracking furnace.

20. The method of claim 6, comprising:

adding the phosphoric triamide to a mixture of steam and a petroleum feedstock; and passing the resulting admixture through a cracking furnace.

* * * * *